United States Patent [19]

Hantscho

[11] 4,058,058

[45] Nov. 15, 1977

[54] INK FOUNTAIN FOR PRINTING PRESSES

[75] Inventor: Walter G. Hantscho, Pound Ridge, N.Y.

[73] Assignee: George Hantscho Company, Inc., Mount Vernon, N.Y.

[21] Appl. No.: 661,739

[22] Filed: Feb. 26, 1976

[51] Int. Cl.[2] ..... B41F 31/04

[52] U.S. Cl. ..... 101/365; 101/364

[58] Field of Search ..... 101/350, 351, 352, 349, 101/363, 364, 365, 206, 207, 208–210

[56] References Cited

U.S. PATENT DOCUMENTS

| | | | |
|---|---|---|---|
| 194,218 | 8/1877 | Campbell | 101/364 |
| 225,964 | 3/1880 | Bennett | 101/365 X |
| 358,473 | 3/1887 | Nuebling | 101/365 |
| 1,825,999 | 10/1931 | Fankboner | 101/365 |
| 2,449,909 | 9/1948 | Putnam et al. | 101/364 |
| 2,837,024 | 6/1958 | Dougan | 101/365 |
| 3,176,611 | 4/1965 | Tripp | 101/364 |
| 3,294,060 | 12/1966 | McIntyre et al. | 101/169 |
| 3,318,239 | 5/1967 | Wintzer | 101/364 |
| 3,559,573 | 2/1971 | Hantscho | 101/365 |
| 3,730,090 | 5/1973 | Lamberg | 101/365 |
| 3,800,702 | 4/1974 | Roberts | 101/365 |
| 3,895,575 | 7/1975 | Cappel | 101/365 X |
| 3,913,479 | 10/1975 | Cappel | 101/365 |

FOREIGN PATENT DOCUMENTS

| | | | |
|---|---|---|---|
| 454,954 | 1/1928 | Germany | 101/350 |

*Primary Examiner*—J. Reed Fisher

*Attorney, Agent, or Firm*—Eugene E. Geoffrey, Jr.

[57] ABSTRACT

An ink fountain for printing presses including a fountain roller and fountain assembly cooperating with said roller and having doctoring means forming a metering gap with said roller, said fountain assembly having a bottom surface forming an angle of at least 60° with a tangent of said roller at the metering gap.

2 Claims, 9 Drawing Figures

6
6
5
5
7
7
25
26
27
28
29
30
32
32'
33
33'
34
35
36
37
38
48
50
51
52

28
29
30
32
34
37
38

27
30
33
34
34'
35
36
51
52

INK FOUNTAIN FOR PRINTING PRESSES

This invention relates to printing presses such as offset presses and the like and more specifically to a novel and improved ink fountain therefor which greatly facilitates the control of ink applied to the fountain roller so that the latter will always be coated with a substantially uniform layer of ink of the desired thickness throughout its length.

One form of ink fountain is disclosed in U.S. Pat. No. 3,559,573. In that patent means are disclosed which compensate for deflection of the doctoring means to produce more uniform clearance throughout the length of the roller. This is attained by forming the doctoring means in discrete sections which are independently adjustable. It has been found, however, that in addition to deflection of the doctoring means caused by the viscosity of the ink and speed of operation, roller deflection is also encountered. While compensation for roller deflection can be effected with the structure of the aforesaid patent, such compensation does not correct the cause. With this invention, deflection of both, the roller and doctoring means, are substantially minimized, and variations in ink viscosity, whether produced by temperature changes or other causes, and speed of operation, will have a minimum affect on the quantity of ink applied to the ink roller and the uniformity of the ink layer throughout the length of the ink roller.

Another object of the invention resides in the provision of a novel and improved arrangement of doctoring means, fountain roller and fountain which reduces deflection of both, the doctoring means, and roller, and greatly facilitates adjustment of the doctoring means to attain more accurate control over the ink supply.

Still another object of the invention resides in the provision of a novel and improved ink fountain assembly for printing presses.

The foregoing objects are attained through the provision of an improved arrangement of the fountain assembly and fountain roller wherein the fountain assembly is positioned relative to the roller to provide a substantially uniform application of ink to the fountain roller notwithstanding changes in viscosity of the ink and speed of operation of the press.

The above and other objects and advantages of the invention will become more apparent from the following description and accompanying drawings forming part of this application. In the drawings.

Figure 4:
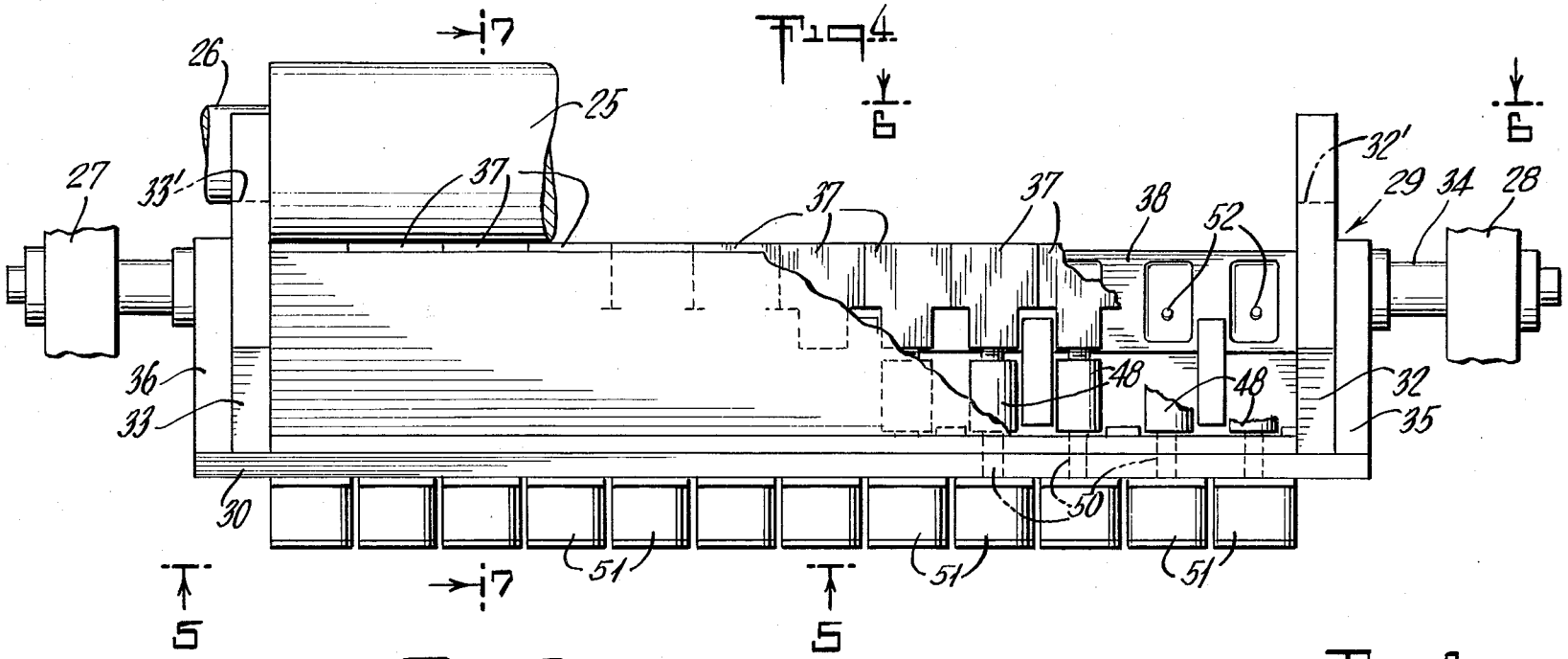
FIG. 4 is a plan view of an ink fountain embodying a form of the invention similar to that illustrated in FIG. 3.
Figure 6:
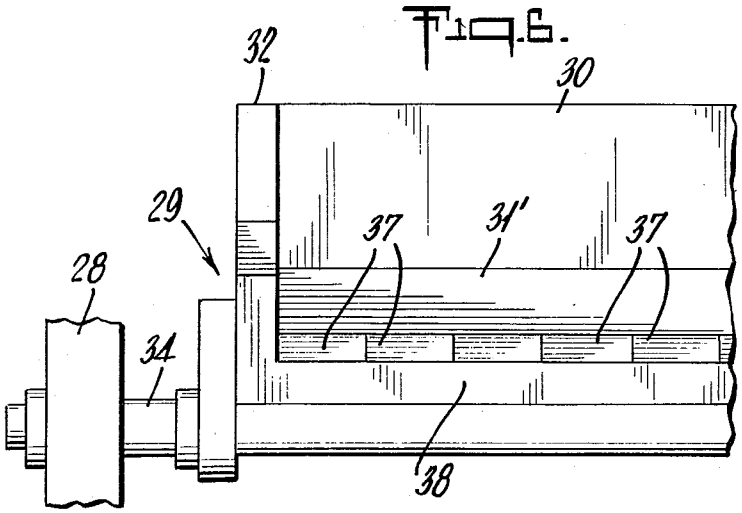
Figure 5:
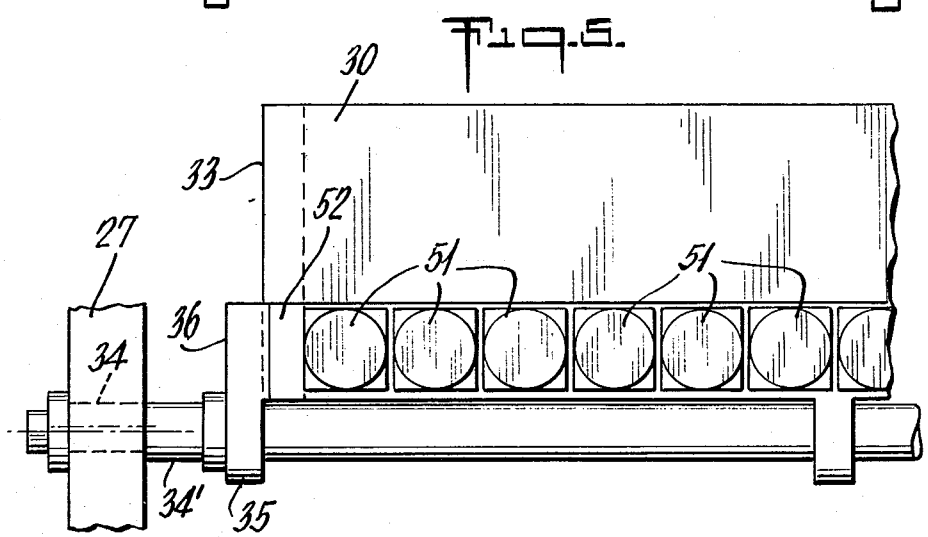
Figure 7:
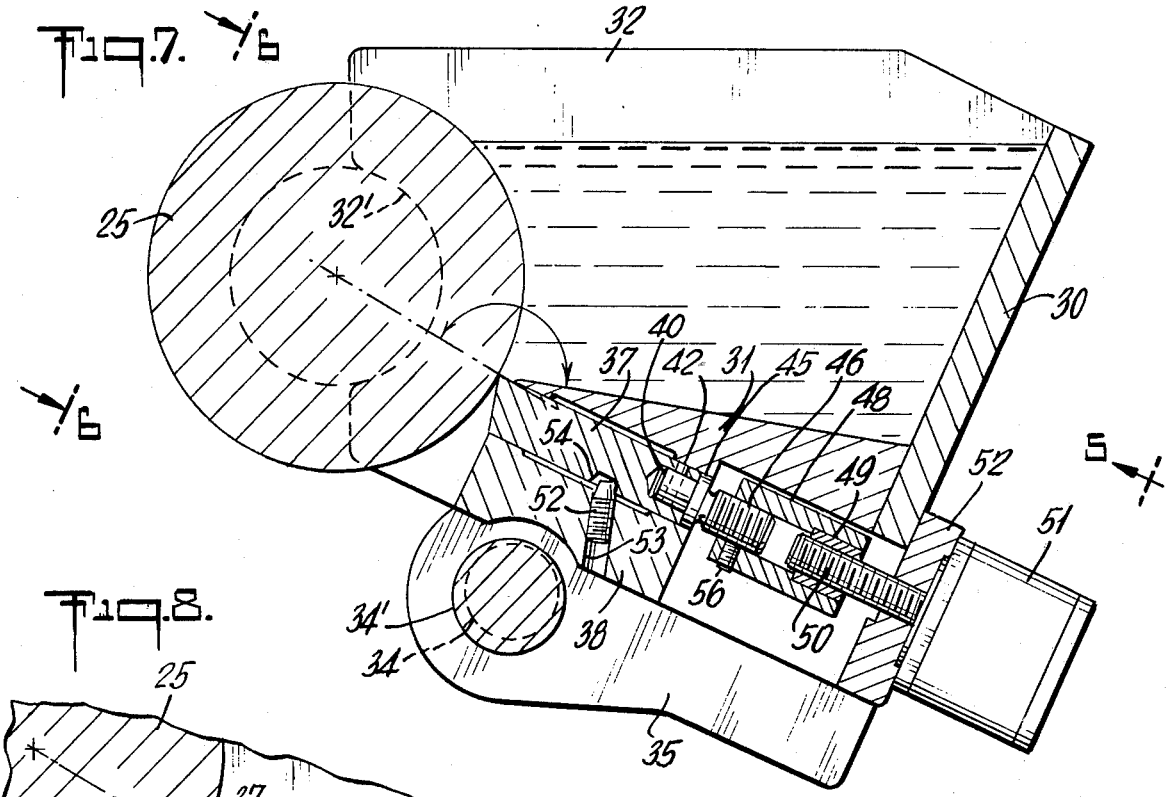
Figure 8:
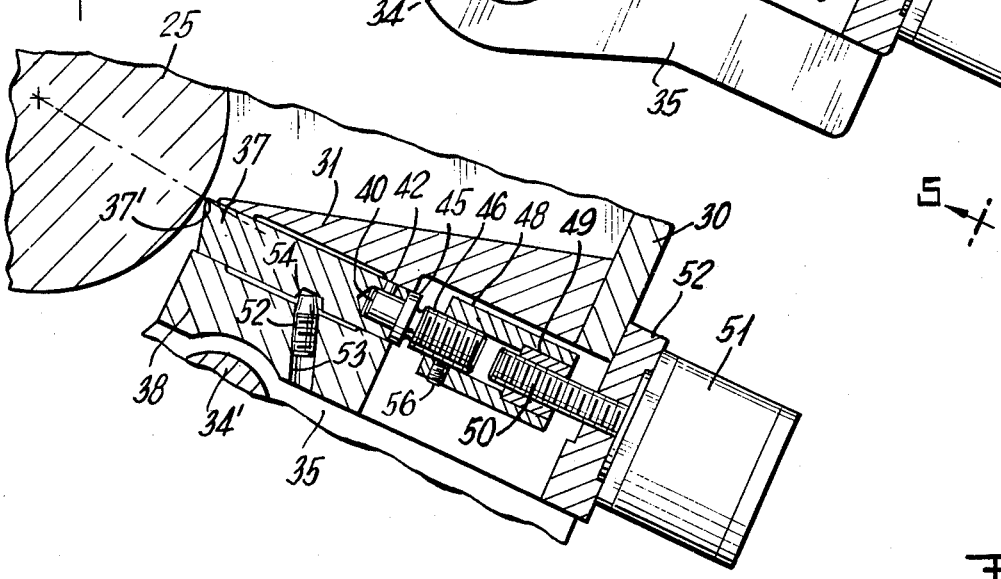
Figure 9:
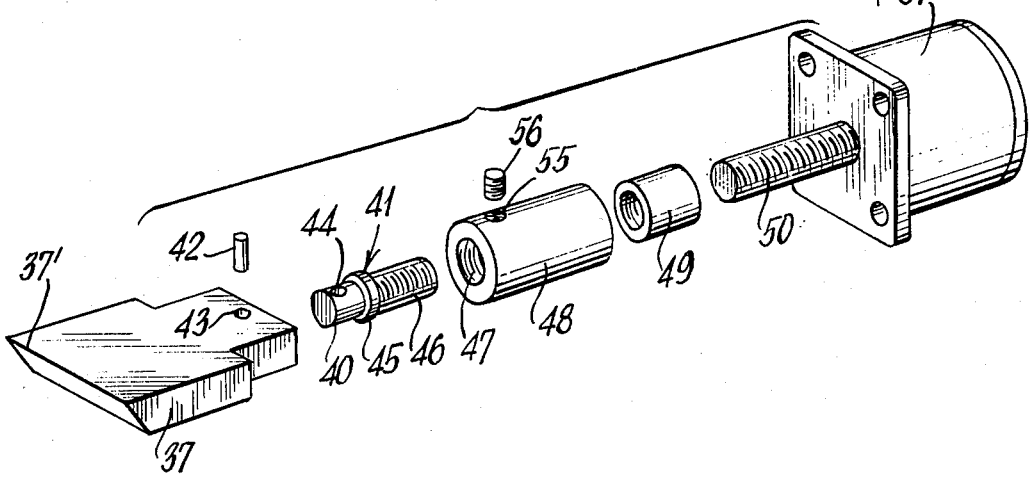

FIGS. 5, 6 and 7 are cross sectional view of FIG. 4 taken along the lines 5 — 5, 6 — 6 and 7 — 7 thereof;

FIG. 8 is a cross sectional view similar to FIG. 7 but with the doctoring means in a withdrawn position;

FIG. 9 is an exploded perspective view of the apparatus for adjusting individual keys forming the doctoring means.

Ink fountains have presented considerable difficulty in the past as it is essential that precise amounts of ink must be applied uniformly throughout the length of the fountain roller in order to insure application of ink uniformly throughout the length of the form rollers and thence to the printing plate. One of the serious difficulties heretofore encountered has been the deflection of both the fountain roller and the doctoring means produced by the viscosity of the ink and the speed of operation. It was previously considered, however, that the principal problem involved only the doctoring means and the associated support, but a careful study indicated that bending of rollers as large as 6 inches in diameter also occurred. Thus increasing the stiffness of the doctoring means was not found to provide a solution to the problem. While the problem is aggravated with higher viscosity inks, it is nevertheless present with low viscosity inks at normal speeds of operation of presses encountered today.

This invention overcomes the problems heretofore encountered in controlling the supply of ink to a fountain roller and enables the uniform application of ink to the fountain roller in precise quantities through an improved disposition of the fountain assembly including the doctoring means relative to the fountain roller. The doctoring means comprehends that element actually metering the ink, while the bottom of the ink fountain is that portion adjoining the doctoring means which cooperates with the remainder of the fountain to retain the ink in contact with the fountain roller. Thus the bottom of the fountain assembly may include the doctoring means as an integral part thereof.

Figure 1:
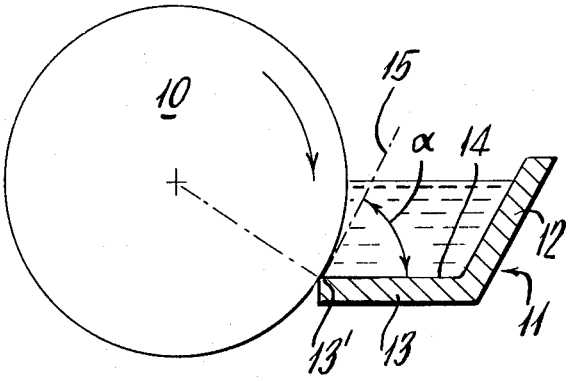
FIG. 1 is a diagrammatic cross sectional view of an ink fountain in accordance with the invention.
Figure 2:
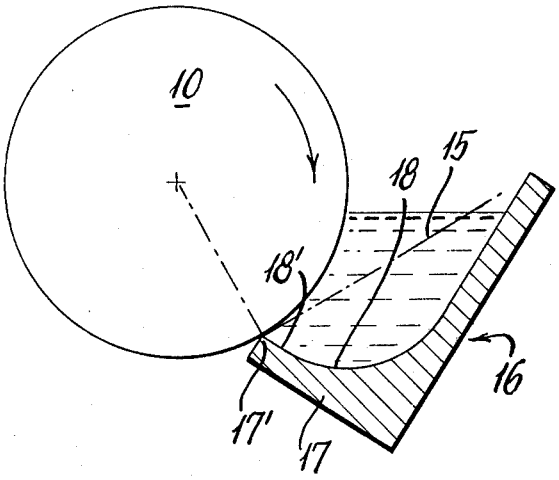
FIG. 2 is a diagrammatic cross sectional view of a modified ink fountain in accordance with the invention.
Figure 3:
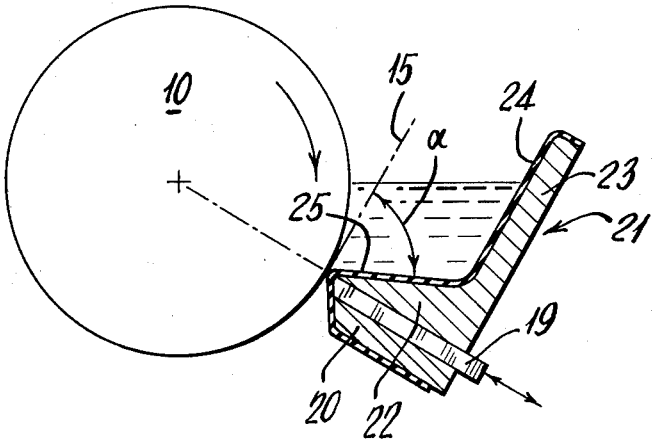
FIG. 3 is a diagrammatic cross sectional view of still another embodiment of an ink fountain in accordance with the invention.

Referring now to the drawings, it will be observed that FIGS. 1 to 3 illustrate diagrammatically three forms of the invention which effectively minimize both roller and blade deflection and thus enable more accurate metering of the ink applied to the fountain roller. In FIG. 1 the fountain roller is denoted by the number 10, while the fountain assembly is denoted by the numeral 11. The fountain includes a rear wall 12 and a bottom wall 13, the latter having a metering edge 13' adapted to be moved toward and away from the roller 10 to control the amount of ink applied to the roller. In this illustration the doctoring means 13' constitutes an integral part of the bottom wall 13, though in many instances the doctoring means and the bottom wall may comprise separate elements. It has been found that effective metering of the ink applied to the roller 10, is principally a function of the angle of the bottom 13 relative to a tangent to the roller at the point where the metering takes place. More specifically, the top surface 14 of the bottom 13 should be disposed at an angle $\alpha$ relative to the tangent 15, which is at least 60°. With this arrangement, it has been noted that deflection of both the doctoring means 13' as well as the roller 10 will experience little, if any, significant deflection. Thus while an increase in the rigidity of both the doctoring means 13' and adjoining supporting structure has a significant affect on the metering operation, such a procedure does not eliminate the basic cause of deflection of the doctoring means and in fact results in an increase in the deflection of fountain rollers as large as 6 inches in diameter. With the arrangement, as shown in FIG. 1, little, if any, deflection of either the roller or the doctoring means will occur.

FIG. 2 illustrates a modified form of ink fountain 16 wherein the bottom wall 17 has a curved inner surface 18, which slopes downwardly and outwardly from the doctoring means 17' which is in fact the forward edge of the bottom 17. In this instance that portion 18' of the bottom immediately adjoining the doctoring means 17', makes an angle with the tangent 15 greater than 60°. The curved surface also provides a smooth path so that ink can readily circulate within the fountain as a result of the rotation of the fountain roller.

FIG. 3 illustrates still another modification of the invention and utilizes as the doctoring means a plurality of individual keys 19 which are placed in contiguous relationship and extend throughout the length of the fountain roller 10. The keys 19 are all individually movable relative to the fountain roller, as described in the aforementioned U.S. Pat. No. 3,559,573. The keys 19 are supported by a bottom plate 20 and are retained in position by the fountain structure 21, consisting of a bottom wall 22 and a rear wall 23. In order to prevent ink from interferring with the movement of the keys 19, the inner surface of the fountain 21 and the forward edges of the keys 19 may be enclosed by a plastic layer 24 of resilient material. As in the case of the preceding embodiments of the invention, the inner surface 25 of the bottom wall 22 makes an angle of at least 60° with the tangent 15.

From the foregoing description it is evident that the ink fountain can be constructed in any desirable manner provided, however, that the bottom surface of the fountain adjoining the point at which the ink is metered, makes an angle $\alpha$ of at least 60° with the tangent of the fountain roller at the metering point.

An embodiment of a fountain roller and adjoining fountain assembly utilizing the principles of this invention, is illustrated in FIGS. 4 through 9. In this embodiment of the invention, the fountain roller, denoted by the numeral 25, is supported by shafts 26 extending from the ends thereof which engage bearing (not shown) carried by the side frames 27 and 28 of the printing press. The ink fountain is generally denoted by the numeral 29 and comprises a rear wall 30, and a bottom wall 31 and side wall 32 and 33. The assembly is supported by a transverse shaft 34 which engages a pair of side plates 35 and 36, the latter being secured to the side walls 32 and 33, respectively. Eccentric bearings 34' are fixed in the frames 27 and 28, as shown more clearly in FIG. 7, to provide a preliminary adjustment of the fountain assembly relative to the fountain roller 25. It will also be observed that the side walls 32 and 33 have annular recesses 32' and 33', which closely engage the shaft portions 26 carrying roller 25.

The doctoring means which is shown more clearly in FIGS. 7, 8 and 9, comprises a plurality of keys 37 which are placed in contiguous, co-planar relationship and extend throughout the length of the roller 25. The keys are slideably disposed between the bottom plate 38, extending between the side walls 32 and 33, and the bottom wall 31, the latter being of generally triangular configuration and overlies all but a very narrow end portion of the keys 37. The forward edge of each key 37 is preferably tapered to provide a sharp doctoring edge 37', while the rear portion of each key includes a recess 39 to receive the cylindrical portion 40 of a stud 41. The cylindrical portion 40 is fixed in the opening 39 by a pin 42 extending through alined holes 43 and 44, of the key 47, and the cylindrical portion 40, respectively. An annular shoulder 45 on the stud 41 fixes longitudinal the position of the stud relative to the key 37. The outer portion 46 of the stud 41 is threaded and engages a threaded hole 47 in the sleeve 48. The right-hand end of the sleeve 48, as illustrated in FIG. 9, is provided with a threaded insert 49 for engagement with a threaded shaft 50 of the motor 51.

The individual motors 51 which are provided for each key, are carried by a transverse support 52 secured to the brackets 35 and 36 and to the rear wall 30. Longitudinal movement of each key is limited by means of a set screw 52 threadably engaging an opening 53 in the plate 38 and extending into a recess 54 in the underside of the associated key. By moving each key to the forward-most position, the eccentrics 34' can be adjusted to limit the forward movement of the keys and thereby prevent them from contacting and, possibly, damaging the roller 25. In order to prevent rotation of the sleeve 48 relative to the key 37, the sleeve is provided with a threaded opening 55 and set screw 56 to fix the sleeve relative to the stud 41. With this arrangement, operation of the motors 51 will function to move the associated keys toward or away from the roller 25, as may be desired.

The motors 51 may be of any suitable construction and include speed reduction mechanisms to provide extremely low rotational speeds of the shafts. In the alternative, the motors may be in the form of step motors which can be moved in one direction of the other through predetermined angles by the application of electrical pulses. Selsyn motors may also be used to effect adjustment of the keys. In actual practice, the motor would be operated from a remote location by any suitable means well known in the art, and appropriate indicators may be provided to give the operator indiction of the position of each key.

It will be observed in the embodiment of the invention shown in FIGS. 4 through 9, that the angle between a tangent to the roller at the metering point, and the surface 31' of the bottom plate 31 forms an angle in excess of 65°. In actual practice, roller deflections as small as 0.0001 inch have been obtained with fountain rollers in the order of 4½ inches in diameter. At the same time blade deflections in a horizontal direction were as low as 0.0001 inch, while in the vertical direction were 0.001 inch. However, vertical deflection of the blade has much less affect on the metering gap and thus, in normal press operation, variations in the metering gap can be kept as low as approximately 0.0002 inch. Gap variations of this order can easily be compensated for by the use of the individual keys, each of which is independently adjustable.

While only one embodiment of the invention has been illustrated and described, it is understood that variations, changes and modifications may be made without departing from the true scope and spirit thereof.

What is claimed is:

1. An ink fountain for a printing press comprising a fountain roller and cooperating reservoir, said reservoir including a pair of end walls, a rear wall and a bottom wall and bottom plate extending between said end walls, said bottom plate slidably carrying a plurality of keys in coplanar contiguous relationship, reversible motors carried by said rear wall and having threaded shafts, threaded means carried by each of said keys and engaging a motor shaft for moving said key toward and away from said roller and thus forming a metering gap, said bottom wall overlying said keys and said keys and bottom wall each forming an angle with a tangent to said roller at said metering gap of at least 60°, each of said keys including a recess on the underside thereof and said bottom support includes a plurality of threaded openings and set screws in said openings and protruding into said recesses for limiting movement of said keys, said threaded means comprising a threaded stud secured to and extending from each key, a sleeve having one end threadably engaging said stud and the other end threadably engaging said motor shaft, and means for adjustably fixing said sleeve relative to said stud.

2. An ink fountain for a printing press comprising a fountain roller and cooperating reservoir, said reservoir including a pair of end walls, a rear wall and a bottom wall and bottom plate extending between said end walls, said bottom plate slidably carrying a plurality of keys in coplanar contiguous relationship, reversible motors carried by said rear wall and having threaded shafts, threaded means carried by each of said keys and engaging a motor shaft for moving said key toward and away from said roller and thus forming a metering gap, said bottom wall overlying said keys and said keys and bottom wall each forming an angle with a tangent to said roller at said metering gap of at least 60°, said threaded means comprising a threaded stud secured to and extending from each key, a sleeve having one end threadably engaging said stud and the other end threadably engaging said motor shaft, and means for adjustably fixing said sleeve relative to said stud.

* * * * *